United States Patent [19]

Nakamura et al.

[11] Patent Number: 4,472,326

[45] Date of Patent: Sep. 18, 1984

[54] VARIABLE VENTURI-TYPE CARBURETOR

[75] Inventors: Norihiko Nakamura; Takaaki Itoh; Takashi Katou, all of Mishima; Yozo Ota, Chiryu; Toshiharu Morino, Mie, all of Japan

[73] Assignees: Toyota Jidosha Kabushiki Kaisha; Aisan Industry Co., Ltd., both of Japan

[21] Appl. No.: 397,697

[22] Filed: Jul. 13, 1982

[30] Foreign Application Priority Data

Dec. 21, 1981 [JP] Japan ..... 56-205206

[51] Int. Cl.[3] ..... F02M 9/06

[52] U.S. Cl. ..... 261/144; 261/44 C; 261/39 A; 261/121 B; 261/DIG. 20

[58] Field of Search ..... 261/44 C, DIG. 20, 144, 261/39 A, 121 B

[56] References Cited

U.S. PATENT DOCUMENTS

| | | | |
|---|---|---|---|
| 2,655,141 | 10/1953 | Hayden | 261/DIG. 20 |
| 2,877,753 | 3/1959 | Larsen | 261/DIG. 20 |
| 2,890,871 | 6/1959 | Lunn | 261/DIG. 20 |
| 3,764,120 | 10/1973 | Imai | 261/44 C |
| 3,875,917 | 4/1975 | Scarritt, Sr. | 261/44 C |
| 3,925,521 | 12/1975 | Otani | 261/44 C |
| 4,089,314 | 5/1978 | Bernecker | 261/144 |
| 4,276,238 | 6/1981 | Yoshikawa et al. | 261/44 C |
| 4,371,478 | 2/1983 | Wada | 261/44 C |
| 4,371,479 | 2/1983 | Nakamura et al. | 261/44 C |

FOREIGN PATENT DOCUMENTS

| | | | |
|---|---|---|---|
| 1224762 | 3/1971 | United Kingdom | 261/44 C |
| 2030229 | 4/1980 | United Kingdom | 261/44 C |

*Primary Examiner*—Tim R. Miles

*Attorney, Agent, or Firm*—Finnegan, Henderson, Farabow, Garrett & Dunner

[57] ABSTRACT

A variable venturi-type carburetor comprising a fuel passage which is open to an intake passage. An air bleed passage is connected to the fuel passage. The carburetor comprises an air bleed control valve device for controlling the flow area of the air bleed passage. The air bleed control valve device comprises a bore formed therein, a push rod slidably inserted into the bore for controlling the flow area of the air bleed passage, and a wax valve actuating the push rod. A cooling water passage is formed in the air bleed control valve device so as to surround the air bleed passage and the wax valve.

7 Claims, 2 Drawing Figures

VARIABLE VENTURI-TYPE CARBURETOR

BACKGROUND OF THE INVENTION

The present invention relates to a variable venturi-type carburetor.

A variable venturi-type carburetor has been known which comprises: a suction piston changing the cross-sectional area of a venturi portion in accordance with a change in the amount of air fed into the cylinder of the engine; a needle fixed onto the suction piston; a fuel passage extending in the axial direction of the needle so that the needle can enter into the fuel passage; a metering jet arranged in the fuel passage and cooperating with the needle; and an air bleed passage for feeding air into the fuel passage. However, in such a carburetor, water, contained in air fed from the air bleed passage into the fuel passage, freezes in the cold season, thus icing the needle. This results in a lean air-fuel mixture fed into the cylinder of the engine, thereby obstructing good engine operation. In addition, the low temperature of air fed from the air bleed passage into the fuel passage reduces the temperature of the fuel flowing within the fuel passage, thus increasing the viscosity of the fuel. This slows the flow of the fuel within the fuel passage, reducing the amount of fuel fed into the cylinder of the engine and, thus, increasing the air-fuel ratio of the air-fuel mixture fed into the cylinder of the engine over the predetermined value.

SUMMARY OF THE INVENTION

An object of the present invention is to provide a variable venturi-type carburetor capable of feeding an air-fuel mixture of an optimum air-fuel ratio into the cylinder of the engine even in a cold season by preventing icing of the needle and by preventing the increase of the viscosity of the fuel in the fuel passage.

According to the present invention, there is provided a variable venturi-type carburetor comprising: an intake passage formed in the carburetor and having an inner wall; a suction piston transversely movable in said intake passage in response to a change in the amount of air flowing within said intake passage, said suction piston having a tip face which defines a venturi portion in said intake passage; a float chamber formed in the carburetor; a fuel passage interconnecting said float chamber to said intake passage; a metering jet arranged in said fuel passage; a needle fixed onto the tip face of said suction piston and extending through said fuel passage and said metering jet; and air bleed passage having an air outlet at one end thereof which is open to said fuel passage and having an air inlet at the other end thereof which is open to the atmosphere; an air bleed control device mounted on the carburetor and arranged in said intake passage for controlling the flow area of said air bleed passage, said air bleed passage extending through the carburetor and said air bleed control device; and a coolant passage surrounding said air bleed passage for heating air flowing within said air bleed passage.

The present invention may be more fully understood from the description of a preferred embodiment of the invention set forth below, together with the accompanying drawings.

DESCRIPTION OF A PREFERRED EMBODIMENT

Figure 1:
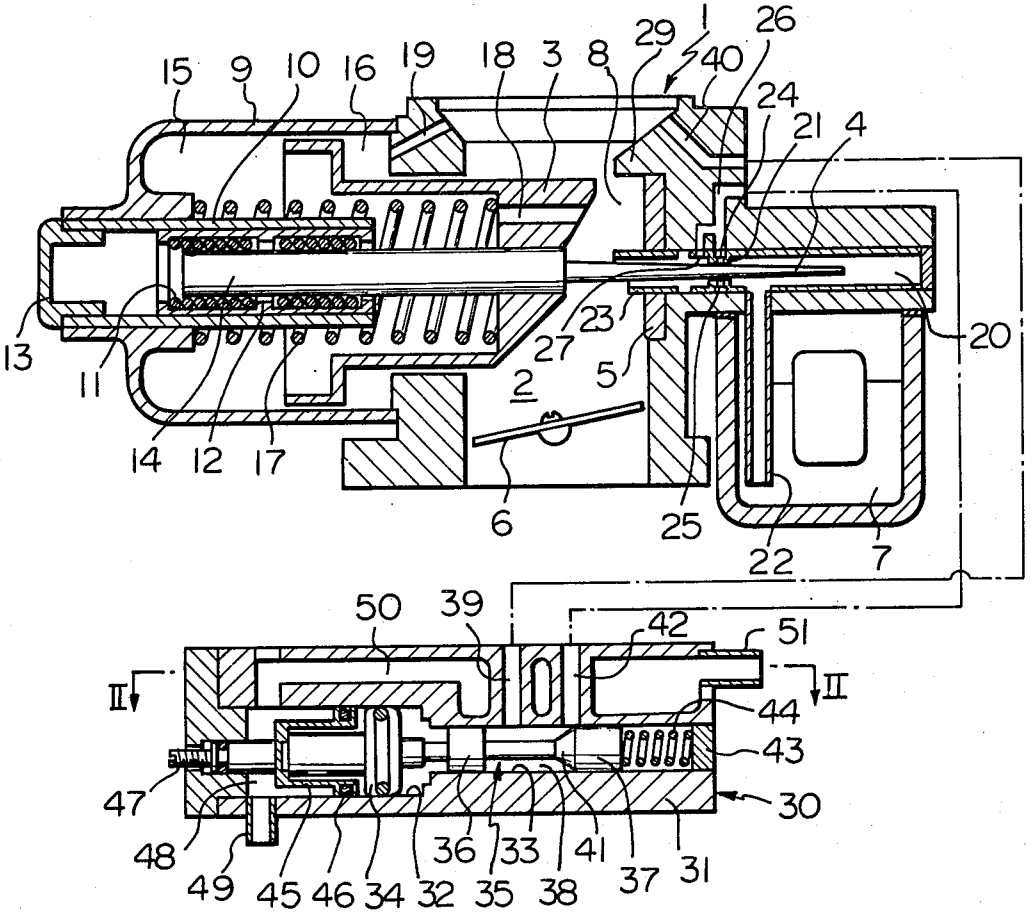
FIG. 1 is a cross-sectional side view of a variable venturi-type carburetor and an air bleed control valve device according to the present invention.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3; 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1, and a guide sleeve 10, extending within the casing 9 in the axial direction of casing 9, is attached to the casing 9. A bearing 12, equipped with a plurality of balls 11, is inserted into the guide sleeve 10, and the outer end of the guide sleeve 10 is closed with a blind cap 13. On the other hand, a guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atomospheric pressure chamber 16 by the suction piston 3, and a compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

On the other hand, a fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

An annular air passage 24 is formed around the metering jet 21. A plurality of air bleed bores 25, interconnecting the annular air passage 24 to the interior of the metering jet 21, is formed on the inner circumferential wall of the metering jet 21. The annular air passage 24 is connected to an air bleed passage 26 formed in the carburetor body 1. In addition, an auxiliary air bleed bore 27 is formed on the upper wall of the fuel passage 20 located downstream of the metering jet 21. This auxiliary air bleed bore 27 is connected to the air bleed passage 26.

A raised wall 29, projecting horizontally into the intake passage 2, is formed at the upper end of the spacer 5. Flow control is effected between the raised wall 29 and the tip end portion of the suction piston 3. When the engine is started, air flows downward within the intake passage 2. At this time, since the air flow is restricted between the suction piston 3 and the raised portion 29, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

On the other hand, an air bleed control valve device 30 is mounted on the carburetor body 1. An increased diameter bore 32 and a reduced diameter bore 33 interconnected to each other are formed in a housing 31 of the air bleed control valve device 30. A wax valve 34 is inserted to the increased diameter bore 32, and a push rod 35 actuated by the wax valve 34 is inserted into the reduced diameter bore 33. The push rod 35 has a pair of spaced enlarged portions 36, 37. An interior chamber 38 formed between the enlarged portions 36 and 37 is connected to the intake passage 2, located upstream of the raised wall 29, via an air bleed bore 39 formed in the housing 31 of the air bleed control valve device 30 and via an air bleed bore 40 formed in the carburetor body 1. The enlarged portion 37 of the push rod 35 has a frustrum-shaped inner end 41. An air bleed bore 42, which is covered or uncovered by the inner end 41 of the enlarged portion 37, is formed in the housing 31 of the air bleed control valve device 30. The air bleed bore 42 is connected to the air bleed passage 26 formed in the carburetor body 1. The open end of the reduced diameter bore 33 of the air bleed control valve device 30 is covered by a blind plug 43, and a compression spring 44 is inserted between the blind plug 43 and the push rod 35. On the other hand, a wax valve holder 45 is fitted into the increased diameter bore 32 of the air bleed control valve device 30, and an O ring 46 is inserted between the inner circumferential wall of the increased diameter bore 32 and the outer circumferential wall of the end portion of the wax valve holder 45. In addition, an adjusting screw 47, which is in engagement with the end face of the wax valve holder 45, is screwed into the housing 31 of the air bleed control valve device 30.

An engine cooling water introducing chamber 48 is formed in the increased diameter bore 32 so as to surround the wax valve holder 45. A cooling water inlet pipe 49 connected to the cooling water introducing chamber 48 is fixed onto the housing 31. In addition, a cooling water passage 50, extending along the increased diameter bore 32 and the reduced diameter bore 33, is formed in the housing 31. One end of the cooling water passage 50 is connected to the cooling water introducing chamber 48. The other end of the cooling water passage 50 is connected to a cooling water outlet pipe 51.

Figure 2:
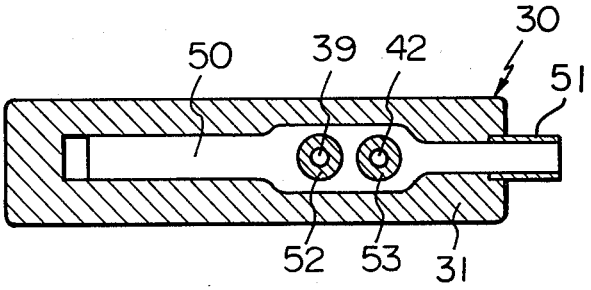
FIG. 2 is a cross-sectional view taken along the line II—II in FIG. 1.

As illustrated in FIG. 2, the air bleed passages 39 and 42 are formed in cylindrical walls 52 and 53 having a thin thickness and extending through the cooling water passage 50, respectively. The cooling water inlet pipe 49 is connected to, for example, the outlet of the water pump (not shown) driven by the engine. Consequently, cooling water, introduced into the cooling water introducing chamber 48 from the cooling water inlet pipe 49, flows within the cooling water passage 50 and, then, in returned to the water jacket of the engine (not shown) via the cooling water outlet pipe 51.

When the engine is started and the temperature of the cooling water of the engine is increased, the wax valve 34 causes the push rod 35 to move toward the right in FIG. 1. This increases the amount of air fed into the interior chamber 38 via the air bleed bores 39, 40 and, therefore, increases amount of air fed into the air bleed passage 26 from the interior chamber 38 via the air bleed bore 42. This, in turn, increases the amount of air fed into the fuel passage 20 from the air bleed bores 25, 27, thereby reducing the amount of fuel fed from the nozzle 23 and, thus, increasing the air-fuel ratio of air-fuel mixture fed into the cylinder of the engine.

As mentioned above, since the air bleed bores 39, 42 are surrounded via the cylindrical walls 52, 53 by the cooling water flowing within the cooling water passage 50, air is heated during the time the air flows within the air bleed bores 39, 42. The air thus heated is fed into the fuel passage 20 from the air bleed bores 25, 27. Consequently, even in a cold season, there is no danger of freezing of the water contained in air fed into the fuel passage 20 from the air bleed bores 25, 27 and, thus, no danger of icing of the needle. In addition, there is also no danger of reduction of the temperature of fuel in the fuel passage 20.

According to the present invention, since it is possible to prevent the needle from being iced, there is no danger that the air-fuel mixture fed into the cylinder of the engine becomes lean. As a result, a good operation of the engine can be obtained. In addition, since it is possible to prevent a reduction of the temperature of fuel, there is no danger of increasing the viscosity of the fuel. As a result, it is possible to always form an air-fuel mixture having the optimum air-fuel ratio.

While the invention has been described with reference to a specific embodiment chosen for purposes of illustration, it should be apparent that numerous modifications could be made thereto by those skilled in the art without departing from the basic concept and scope of the invention.

We claim:

1. A variable venturi-type carburetor comprising:

an intake passage formed in the carburetor and having an inner wall;

a suction piston transversely movable in said intake passage in response to a change in the amount of air flowing within said intake passage, said suction piston having a tip face which defines a venturi portion in said intake passage;

a float chamber formed in the carburetor;

a fuel passage interconnecting said float chamber to said intake passage;

a metering jet arranged in said fuel passage;

a needle fixed onto the tip face of said suction piston and extending through said fuel passage and said metering jet;

an air bleed passage having an air outlet at one end thereof which is open to said fuel passage and having an air inlet at the other end thereof which is open to the atmosphere;

an air bleed control device mounted on the carburetor and arranged in said air bleed passage for controlling the flow area of said air bleed passage, said air bleed passage extending through the carburetor and said air bleed control device; and a coolant passage formed in said air bleed control device for circulation of engine coolant, a portion of said air bleed passage being a thin-walled tube disposed in said coolant passage for heating air flowing within said air bleed passage by heat exchange with said coolant.

2. A variable venturi-type carburetor according to claim 1, wherein said air bleed control device comprises valve means for increasing the flow area of said air bleed passage in response to an increase in the temperature of said coolant, said coolant passage being arranged adjacent to said valve device.

3. A variable venturi-type carburetor according to claim 2, wherein said valve device comprises a bore formed therein, a push rod slidably inserted into said bore for controlling the flow area of said air bleed passage, and a wax valve actuating said push rod, said coolant passage extending along said bore and surrounding said wax valve for actuating it in response to a change in the temperature of the coolant flowing within said coolant passage.

4. A variable venturi-type carburetor according to claim 3, wherein said air bleed passage comprises a first portion and a second portion which extend in said air bleed control device and are open to said bore, said first portion and said second portion being connected to the air inlet and the air outlet of said air bleed passage, respectively, each of said first portion and said second portion being surrounded by a tubular thin wall which extends through said coolant passage.

5. A variable venturi-type carburetor according to claim 1, wherein the air outlet of said air bleed passage is formed on an inner circumferential wall of said metering jet.

6. A variable venturi-type carburetor according to claim 5, wherein said air bleed passage has an auxiliary air bleed passage branched off therefrom and connected to said fuel passage located downstream of said metering jet.

7. A variable venturi-type carburetor according to claim 1, wherein a raised wall is formed on the inner wall of said intake passage, which faces the tip face of said suction piston, at a position located upstream of said suction piston, the tip face of said suction piston having an upstream end portion which cooperates with said raised wall for controlling the amount of air flowing within said venturi portion.

* * * * *